US009553347B2

(12) United States Patent
Kato et al.

(10) Patent No.: US 9,553,347 B2
(45) Date of Patent: Jan. 24, 2017

(54) TRANSMISSION LINE

(71) Applicant: Murata Manufacturing Co., Ltd., Nagaokakyo-shi, Kyoto-fu (JP)

(72) Inventors: Noboru Kato, Nagaokakyo (JP); Satoshi Ishino, Nagaokakyo (JP); Jun Sasaki, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 111 days.

(21) Appl. No.: 14/509,299

(22) Filed: Oct. 8, 2014

(65) Prior Publication Data

US 2015/0024700 A1 Jan. 22, 2015

Related U.S. Application Data

(63) Continuation of application No. PCT/JP2013/066147, filed on Jun. 12, 2013.

(30) Foreign Application Priority Data

Jun. 29, 2012 (JP) ..... 2012-147100

(51) Int. Cl.
*H01P 3/08* (2006.01)
*H01P 1/04* (2006.01)
(Continued)

(52) U.S. Cl.
CPC ..... *H01P 3/08* (2013.01); *H01B 1/026* (2013.01); *H01B 3/18* (2013.01); *H01B 7/0275* (2013.01);
(Continued)

(58) Field of Classification Search
CPC ..... H01P 3/00; H01P 3/06; H01P 3/08; H01P 3/081; H01P 3/085; H01P 1/04; H01B 1/026; H01B 3/18; H01B 7/0275
(Continued)

(56) References Cited

U.S. PATENT DOCUMENTS 3,225,351 A * 12/1965 Chatelain ..... H01Q 13/26 333/238
3,961,296 A * 6/1976 Wiggenhorn ..... H01P 3/085 333/238
2005/0272609 A1 12/2005 Akasegawa et al.

FOREIGN PATENT DOCUMENTS

JP 49-003182 A 1/1974
JP 2011-181352 A 9/2011
(Continued)

OTHER PUBLICATIONS

Official Communication issued in International Patent Application No. PCT/JP2013/066147, mailed on Sep. 3, 2013.

*Primary Examiner* — Benny Lee
*Assistant Examiner* — Albens Dieujuste
(74) *Attorney, Agent, or Firm* — Keating & Bennett, LLP

(57) ABSTRACT

A signal line conductor extends in a direction in which a signal propagates, and a dielectric, surrounding the signal line conductor, also extends in the direction in which the signal propagates. Conductive films that define and function as a ground conductor extend on a side surface of the dielectric in the direction in which the signal propagates. Furthermore, conductive films that define and function as a bridge conductor extend on a side surface of the dielectric in a direction across the direction in which the signal propagates, and thus connect the conductive films to each other.

18 Claims, 23 Drawing Sheets

(51) Int. Cl.

| | |
|---|---|
| ***H01P 3/06*** | (2006.01) |
| ***H01B 1/02*** | (2006.01) |
| ***H01B 3/18*** | (2006.01) |
| ***H01B 7/02*** | (2006.01) |

(52) U.S. Cl.
CPC . *H01P 1/04* (2013.01); *H01P 3/06* (2013.01); *H01P 3/085* (2013.01)

(58) Field of Classification Search
USPC ..... 333/238, 246
See application file for complete search history.

(56) References Cited

FOREIGN PATENT DOCUMENTS

| | | | |
|---|---|---|---|
| JP | 3173143 | U | 1/2012 |
| WO | 2004/077600 | A1 | 9/2004 |

* cited by examiner

TRANSMISSION LINE

BACKGROUND OF THE INVENTION

1. Field of the Invention

The present invention relates to a transmission line, and more specifically to a transmission line configured to transmit a high frequency signal.

2. Description of the Related Art

A representative transmission line connecting a high frequency circuit, a high frequency element and the like with each other for transmitting a high frequency signal is a coaxial cable. The coaxial cable is formed of a central conductor that transmits a high frequency signal and a shield conductor surrounding the central conductor coaxially, and provides a transmission line with excellent shieldability and is also inexpensive, and accordingly, it is used for a variety of high frequency equipment. As mobile equipment is increasingly reduced in size and thickness, however, there is a demand for a cable reduced in thickness to be incorporated in the equipment.

In relation thereto, Japanese Registered Utility Model No. 3173143 proposes a triplate-type transmission line thinner than the coaxial cable and suitable for being incorporated in mobile equipment. When the thus configured transmission line has a flexible resin base material applied thereto, the transmission line can be enhanced in vertical flexibility and thus be disposed in an elongated gap along a curved surface of a casing of a mobile terminal.

In Japanese Registered Utility Model No. 3173143, however, a vertical ground conductor is connected by a via conductor, and this imposes a large burden on fabricating the transmission line.

More specifically, a ground conductor is normally produced of copper foil, conductive paste and the like, i.e., different types of materials, bonded together. When the transmission line is bent and thus used, and there is a via in a vicinity of the bent portion, the interface of the via and the copper foil experiences stress, which may cause breakage and the via may be disconnected. Furthermore, when the via is excessively close to a side surface of a base material, cutting a collective base material into individual pieces causes stress to crack the base material, and accordingly, it is necessary to provide the via inside the side surface with some margin considered. This requires the line to have a width increased more than required for a property or the like and thus imposes a large burden on fabricating the transmission line.

SUMMARY OF THE INVENTION

Accordingly, preferred embodiments of the present invention provide a transmission line that reduces or eliminates a burden imposed on fabricating the transmission line.

According to a preferred embodiment of the present invention, a transmission line includes a signal line conductor extending in a direction in which a signal propagates; a dielectric body extending in the direction in which the signal propagates to bury the signal line conductor therein, and including a first major surface and a second major surface opposite to the first major surface, and a side surface contiguous to the first and second major surfaces; a ground conductor disposed on the first major surface of the dielectric body such that in a plan view a conductor-free portion is provided along the signal line conductor so as to overlap the signal line conductor; and a bridge conductor disposed on the first major surface of the dielectric body so as to straddle the conductor-free portion and also electrically connect to the ground conductor, the bridge conductor being provided on a film wound on the dielectric body.

Preferably, the ground conductor is provided on a film wound on the dielectric body.

Preferably, the bridge conductor and the ground conductor are provided on a single film.

Preferably, the ground conductor is provided on a first film wound on the dielectric body, and the bridge conductor is provided on a second film wound on the first film.

Preferably, the bridge conductor has a length larger than that of a perimeter of the dielectric body.

Preferably, the film is heat-shrinkable.

According to another preferred embodiment of the present invention, a transmission line includes a signal line conductor extending in a direction in which a signal propagates; a dielectric body extending in the direction in which the signal propagates to bury the signal line conductor therein, and including a first major surface and a second major surface opposite to the first major surface, and a side surface contiguous to the first and second major surfaces; a ground conductor disposed on the first major surface of the dielectric body such that in a plan view a conductor-free portion is provided along the signal line conductor so as to overlap the signal line conductor; and a bridge conductor disposed on the first major surface of the dielectric body so as to straddle the conductor-free portion and also electrically connect to the ground conductor, the bridge conductor being a linear conductor wound on the dielectric body.

Preferably, the bridge conductor is wound on the dielectric body helically about an axis, the axis being the direction in which the signal propagates.

Providing a bridge conductor on a side surface of a dielectric allows a signal line to be fabricated with a reduced working load.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
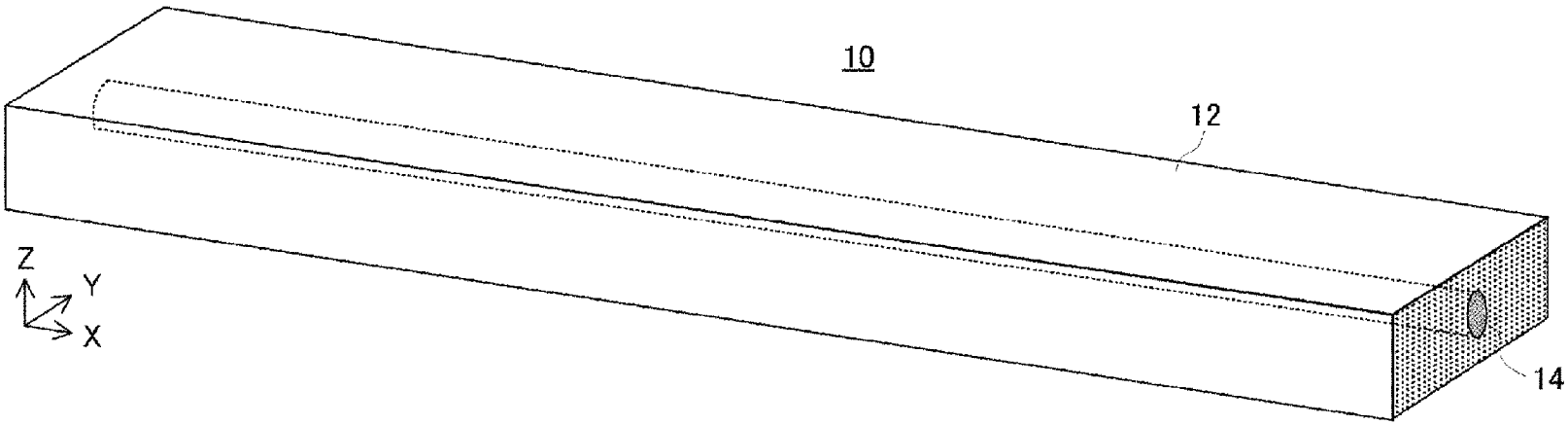
FIG. 1 is a perspective view of a transmission member according to a preferred embodiment of the present invention.

With reference to FIG. 1, the present preferred embodiment provides a transmission member 10 including a dielectric 12 preferably in the form of a square or substantially square pillar with Teflon®, PET, polyimide, or a similar dielectric material defining and serving as a source material. Dielectric 12 is preferably formed of a single material extrusion-molded in one piece. Furthermore, dielectric 12 has a length along an x axis, a width along a y axis, and a thickness along a z axis. The length is adjusted as desired, and the width and the thickness are each adjusted to be uniform along the entire length.

Dielectric 12 has buried therein a signal line conductor 14 extending along the x axis. Signal line conductor 14 is preferably made of a metallic material that contains silver, copper and/or the like as a major component and has a small resistivity serving as a source material, and signal line conductor 14 is buried in dielectric 12 at a center as seen in a cross section thereof perpendicular or substantially perpendicular to the x axis. A high frequency signal propagates through signal line conductor 14 in a direction along the x axis.

Figure 2:
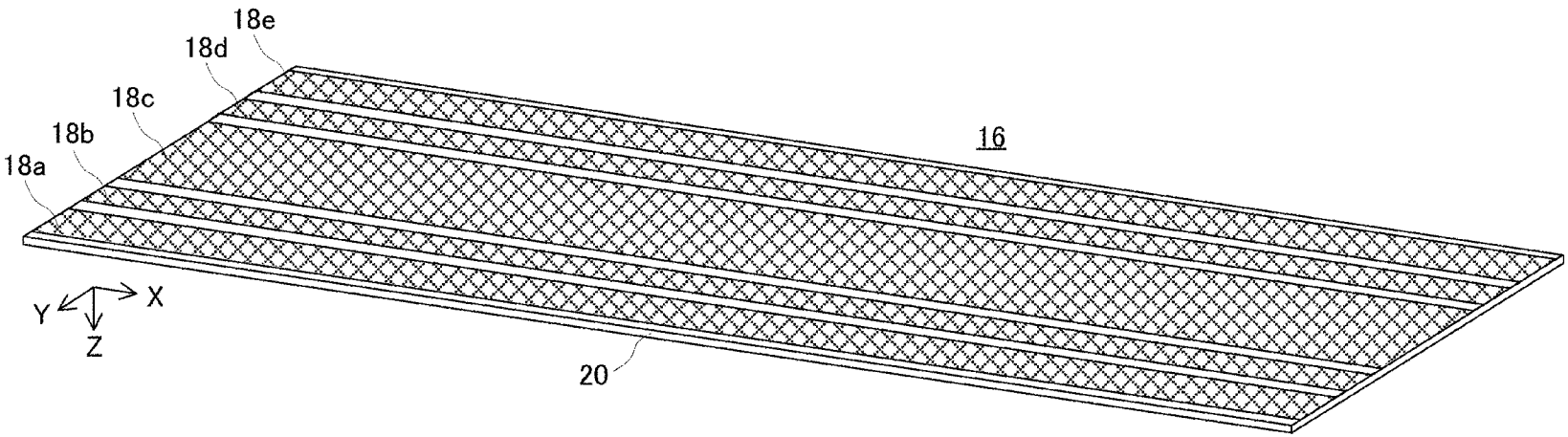
FIG. 2 is a perspective view of one example of a film member provided on the transmission member shown in FIG. 1.

With reference to FIG. 2, a film member 16 preferably includes a dielectric film 20 made of Teflon®, PET, polyimide or a similar, dielectric and heat-shrinkable material defining and serving as a source material; and conductive films 18*a*-18*e* made of aluminum foil defining and serving as a source material, and provided on a major surface of dielectric film 20. Dielectric film 20 includes a major surface preferably in the form of a rectangle having a length, a width, and a thickness along the x, y and z axes, respectively. Furthermore, the length of dielectric film 20 matches or substantially matches that of dielectric 12, and the width of dielectric film 20 matches or substantially matches a perimeter of dielectric 12 about the x axis.

Conductive films 18*a*-18*e* all match or substantially match dielectric film 20 in length. Note, however, that conductive films 18*a* and 18*e* each have a width slightly smaller than about ½ of that of dielectric 12, conductive films 18*b* and 18*d* each have a width slightly smaller than the thickness of dielectric 12, and conductive film 18*c* has a width slightly smaller than that of dielectric 12. Furthermore, conductive films 18*a*-18*e* preferably are printed on a lower surface of dielectric film 20 (i.e., a major surface thereof facing the negative side in a direction along the z axis) in this order toward the negative side in a direction along the y axis in alignment without contacting each other.

Figure 3:
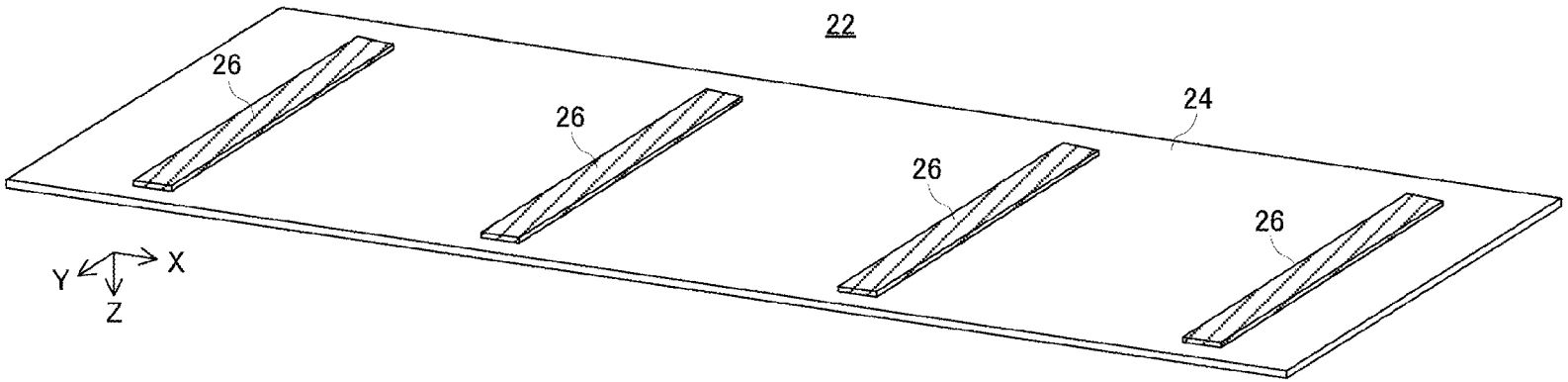
FIG. 3 is a perspective view of one example of another film member provided on the transmission member shown in FIG. 1.

With reference to FIG. 3, a film member 22 preferably includes a dielectric film 24 made of Teflon®, PET, polyimide or a similar, dielectric and heat-shrinkable material defining and serving as a source material; and a plurality of conductive films 26 made of aluminum foil defining and serving as a source material, and printed on a major surface of dielectric film 24. Dielectric film 24 also has the major surface preferably in the form of a rectangle also having a length, a width, and a thickness along the x, y and z axes, respectively. Furthermore, the length of dielectric film 24 matches or substantially matches that of dielectric 12, and the width of dielectric film 24 matches or substantially matches the perimeter of dielectric 12 about the x axis.

Conductive films 26 each preferably include a major surface in the form of a rectangle, for example. Note that the rectangle has a length slightly smaller than the width of dielectric film 24. Furthermore, conductive films 26 are printed on a lower surface of dielectric film 24 (i.e., a major surface thereof facing the negative side in the direction along the z axis) to have their respective lengths extending along the y axis and be also aligned equidistantly or substantially equidistantly in the direction along the x axis.

Figure 4:
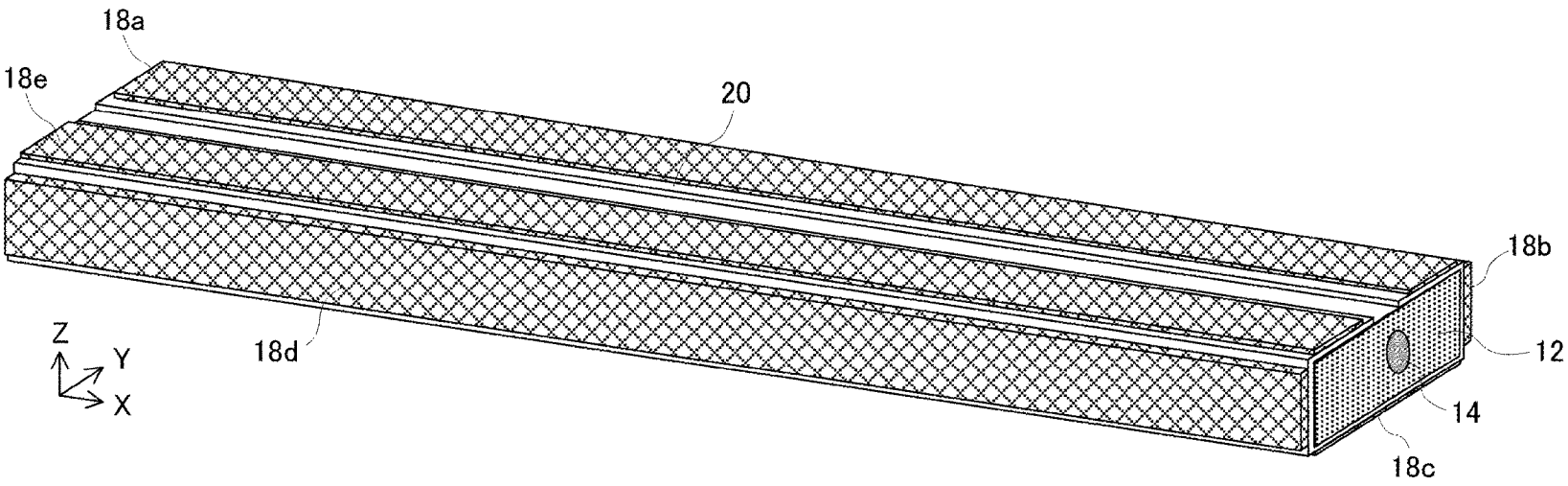
FIG. 4 is a perspective view of the FIG. 2 film member wound on the FIG. 1 transmission member.

The FIG. 2 film member 16 is wound on transmission member 10 preferably in a manner as shown in FIG. 4. More specifically, film member 16 is wound on transmission member 10 about the x axis with dielectric film 20 having the lower surface facing a major or side surface of transmission member 10. In such a wound configuration, conductive films 18*a* and 18*e* have major surfaces, respectively, exposed to the positive side in the direction along the z axis, conductive film 18*b* includes a major surface exposed to the positive side in the direction along the y axis, conductive film 18*c* includes a major surface exposed to the negative side in the direction along the y axis, and conductive film 18*d* includes a major surface exposed to the negative side in the direction along the y axis.

Conductive films 18*a*-18*e* thus attached to transmission member 10 define and function as a ground conductor.

Furthermore, conductive films 18*a*-18*e* cooperate with signal line conductor 14 to define a triplate structure, and between conductive films 18*a* and 18*e* a slit is provided to extend along the x axis. Providing the slit between conductive films 18*a* and 18*e* allows signal line conductor 14 and the ground conductor to have a reduced distance therebetween while maintaining the transmission line's characteristic impedance. In other words, the transmission line is significantly reduced in thickness.

Figure 5:
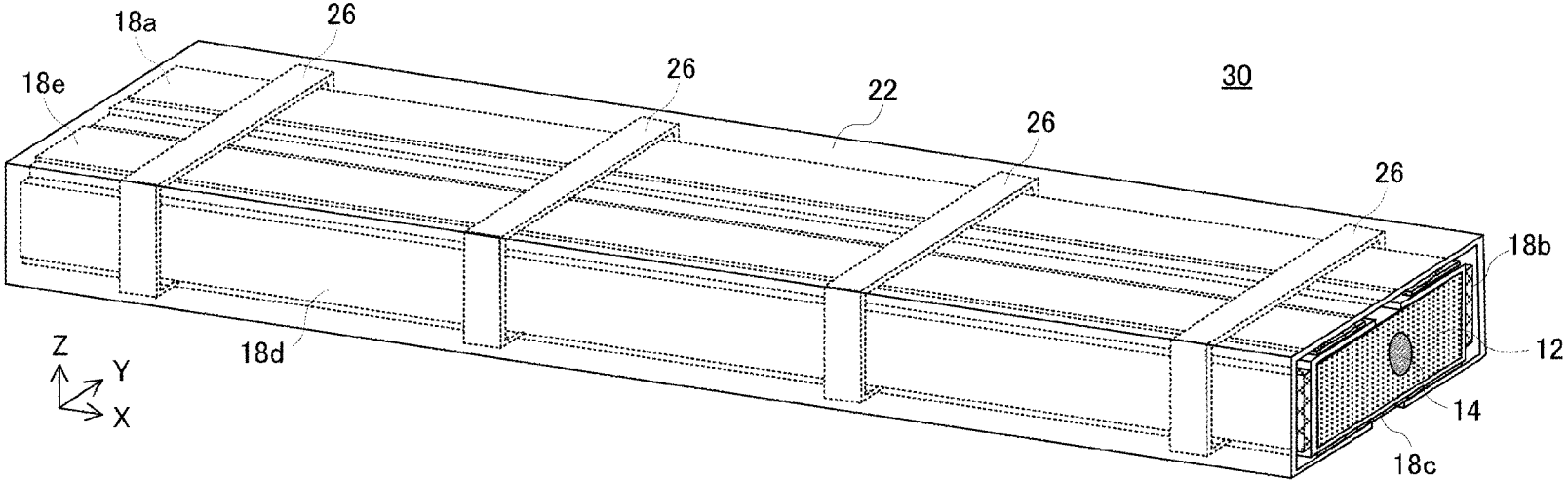
FIG. 5 is a perspective view of a high frequency transmission line that has the FIG. 3 film member further wound and is thus completed.
Figure 6:
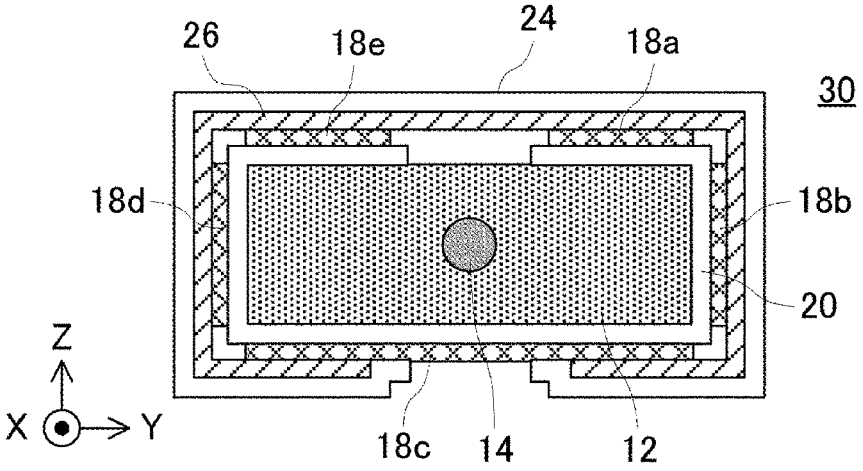
FIG. 6 is a diagram showing the FIG. 5 high frequency transmission line in a cross section perpendicular or substantially perpendicular to an x axis.

The FIG. 3 film member 22 is wound, in a manner as shown in FIGS. 5 and 6, on an external side of film member 16 that has been wound in the manner as shown in FIG. 4. More specifically, the film member is wound about the x axis with dielectric film 22 having the lower surface facing conductive films 18*a*-18*e*. High frequency transmission line 30 thus fabricated includes conductive films 26 each in contact with conductive films 18*a*-18*e*. That is, conductive films 26 define and function as a bridge conductor. This allows conductive films 18*a*-18*e* to be electrically connected in the direction along the x axis equidistantly or substantially equidistantly to stabilize ground potential. In other words, this prevents a large standing wave from arising between the slit's opposite ends as seen in the direction along the x axis, and in turn causing external extraneous emission.

Figure 7:
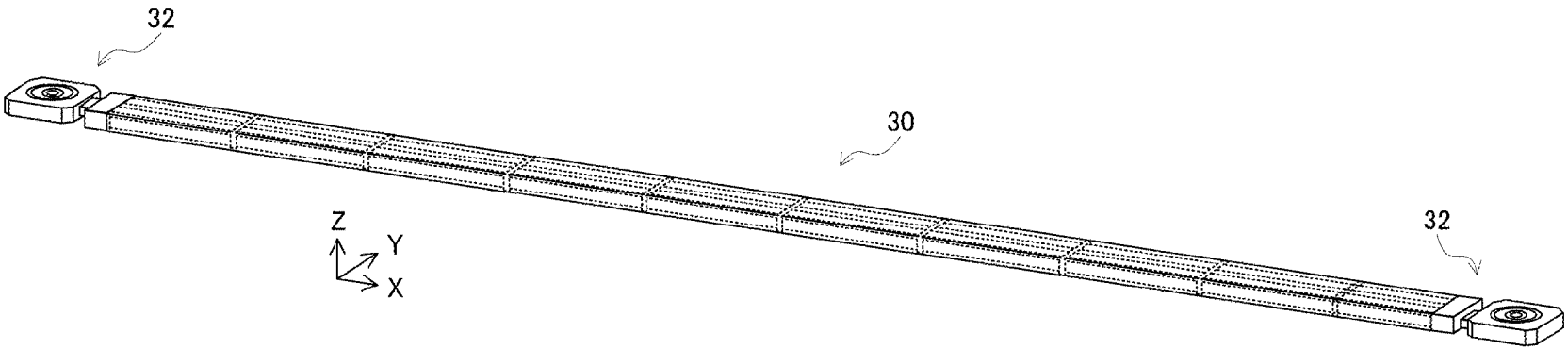
FIG. 7 is a perspective view showing one example of the FIG. 5 high frequency transmission line including opposite ends each with a connector attached thereto.

High frequency transmission line 30 thus fabricated is applied to a mobile communications terminal or similar high frequency equipment to connect between an antenna element or a similar high frequency element and an RF circuit or a similar high frequency device. High frequency transmission line 30 as seen lengthwise has opposite ends with a coaxial connector 32 attached thereto in a manner shown in FIG. 7, and high frequency transmission line 30 is connected to the high frequency device via coaxial connector 32.

Figure 8:
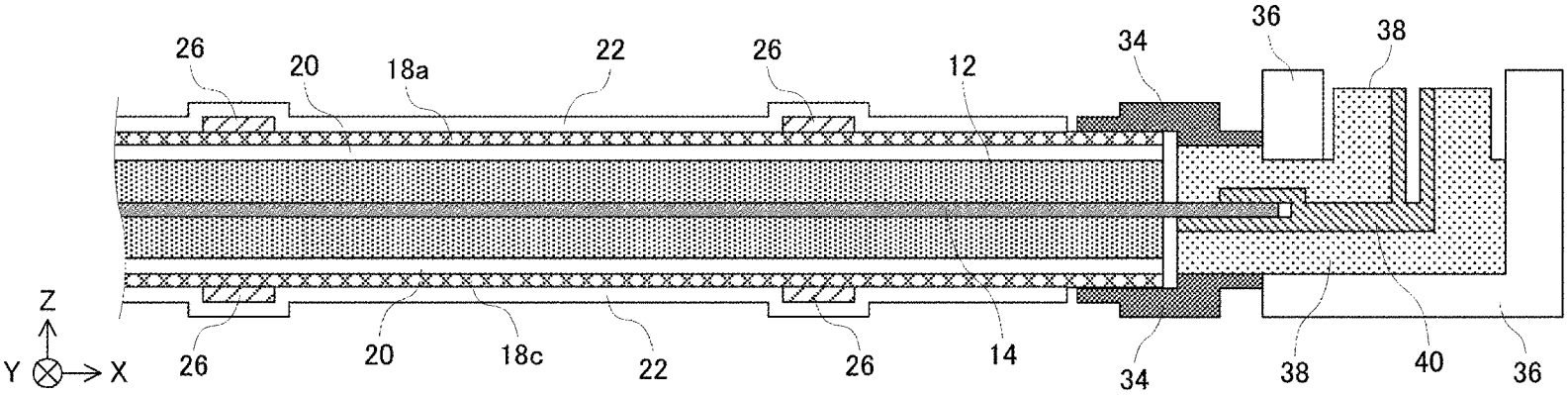
FIG. 8 is a diagram showing a connector attachment portion that is shown in FIG. 7 in a cross section perpendicular or substantially perpendicular to a y axis.

As can be seen in FIG. 8 showing a cross section of coaxial connector 32, a dielectric 38 is accommodated in a metallic jacket 36, and a central conductor 40 is buried in dielectric 38. Furthermore, jacket 36 is provided with an external conductor 34. Coaxial connector 32 is crimped by external conductor 34 to high frequency transmission line 30. In doing so, external conductor 34 is connected to conductive films 18*a*-18*e*, and central conductor 40 is connected to signal line conductor 14.

As can be understood from the above description, signal line conductor 14 extends in a direction in which a signal propagates (i.e., the direction along the x axis), and dielectric 12, surrounding signal line conductor 14, also extends in the direction in which the signal propagates. Conductive films 18*a*-18*e* that define and function as a ground conductor extend on a side surface of dielectric 12 in the direction in which the signal propagates. Furthermore, conductive films 26 that define and function as a bridge conductor extend on a side surface of dielectric 12 in a direction across the direction in which the signal propagates, and thus connect conductive films 18*a*-18*e* to each other.

Connecting a ground conductor by a bridge conductor that is configured of conductive films 26 allows high frequency transmission line 30 to be fabricated with a smaller burden than when a via conductor is provided. Furthermore, providing a bridge conductor outside dielectric 12 eliminates the necessity of providing a lateral margin such as a via conductor and also facilitate optimizing high frequency transmission line 30 in width.

Note that, preferably, conductive films 26 are spaced by a distance equal to or smaller than about ½ of a wavelength corresponding to a maximum frequency of a high frequency signal to be transmitted, for example. Conductive films 26 allow high frequency transmission line 30 to have a characteristic impedance with a discontinuous portion to distribute where a reflected wave is generated to prevent a large standing wave from locally arising.

Furthermore, in this preferred embodiment, the bridge conductor allows signal line conductor 14 and the ground conductor 18 to have an increased capacitance value to provide a point providing a decreased characteristic impedance. To allow the impedance to have the discontinuous portion, however, the slit may be varied in width periodically or the central conductor may be varied in width.

Because dielectric 12 is preferably made of a flexible material such as Teflon®, PET, polyimide, or the like, high frequency transmission line 30 is capable of being controlled in how it can be bent, sprung back and the like by adjusting conductive films 18*a*-18*e* and 26 in thickness.

Figure 9:
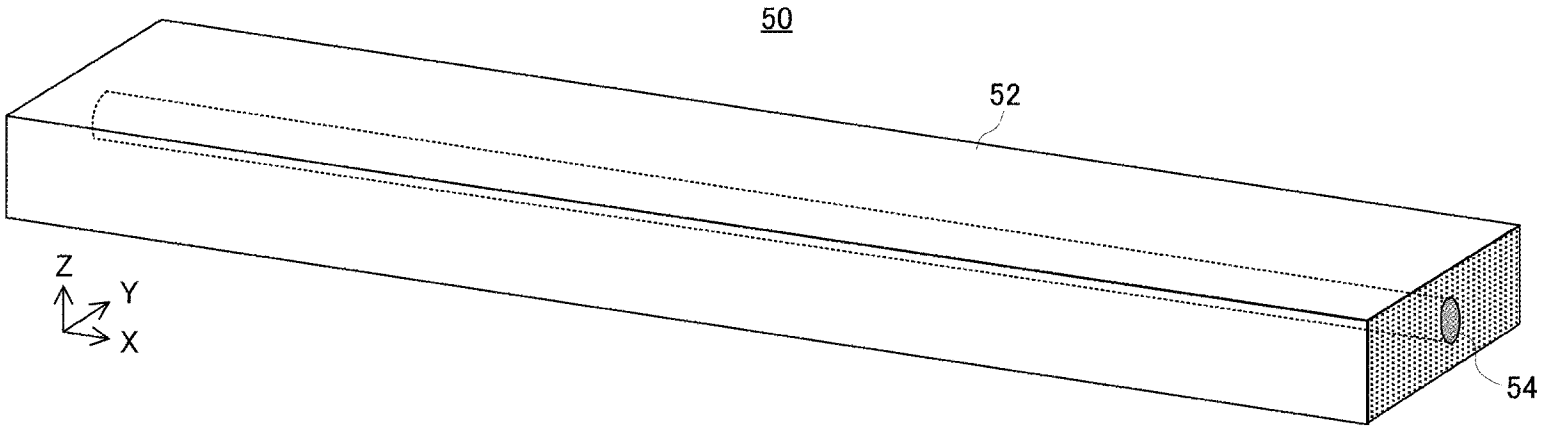
FIG. 9 is a perspective view of a transmission member according to another preferred embodiment of the present invention.

With reference to FIG. 9, another preferred embodiment provides a transmission member 50 including a dielectric 52 preferably with a square or substantially square pillar shape and made of Teflon®, PET, polyimide, or a similar dielectric material defining and serving as a source material. Dielectric 52 preferably is made of a single material extrusion-molded in one piece. Furthermore, dielectric 52 has a length along the x axis, a width along the y axis, and a thickness along the z axis. The length is adjusted as desired, and the width and the thickness are each adjusted to be uniform or substantially uniform along the entire length.

Dielectric 52 has buried therein a signal line conductor 54 extending along the x axis. Signal line conductor 54 is provided with a metallic material that contains silver, copper and/or the like as a major component and has a small resistivity serving as a source material, and signal line conductor 54 is buried in dielectric 52 at a center as seen in a cross section thereof perpendicular or substantially perpendicular to the x axis. A high frequency signal propagates through signal line conductor 54 in the direction along the x axis.

Figure 10:
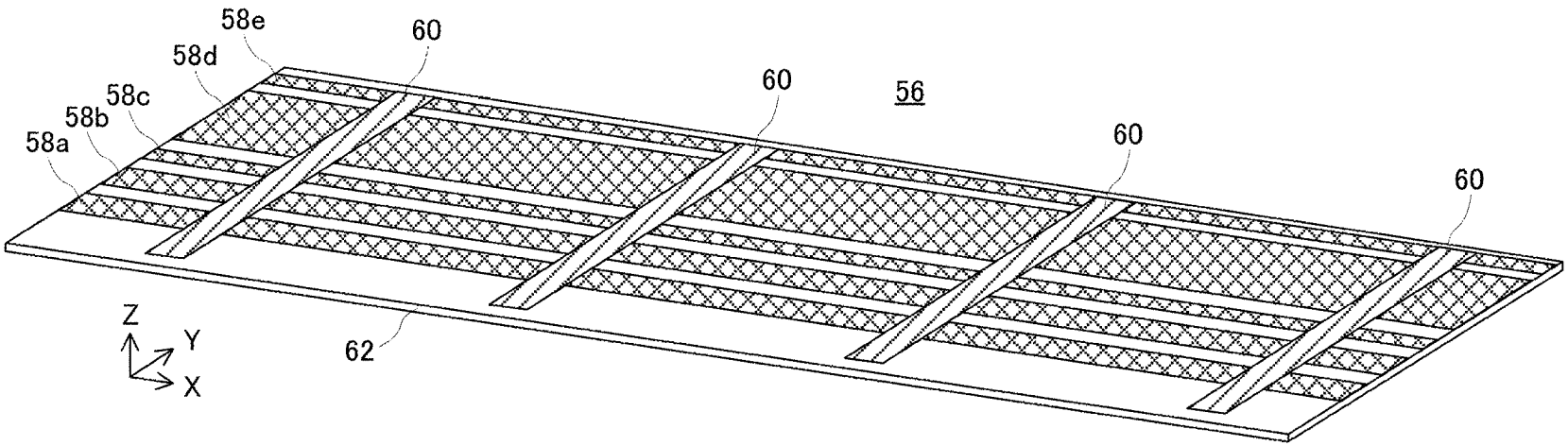
FIG. 10 is a perspective view of one example of a film member provided on the transmission member shown in FIG. 9.

With reference to FIG. 10, a film member 56 preferably includes a dielectric film 62 made of Teflon®, PET, polyimide or a similar, dielectric and heat-shrinkable material defining and serving as a source material; and conductive films 58*a*-58*e*, 60 made of aluminum foil defining and serving as a source material, and printed on a major surface of dielectric film 62. Dielectric film 62 includes a major surface preferably in the form of a rectangle having a length, a width, and a thickness along the x, y and z axes, respectively. Furthermore, the length of dielectric film 62 matches or substantially matches that of dielectric 52, and the width of dielectric film 62 is slightly larger than a perimeter of dielectric 52 about the x axis.

Conductive films 58*a*-58*e* all match or substantially match dielectric film 62 in length. Note, however, that conductive films 58*a* and 58*b* each have a width slightly smaller than about ½ of that of dielectric 12, conductive films 58*c* and 58*e* each have a width slightly smaller than the thickness of dielectric 52, and conductive film 58*d* has a width slightly smaller than that of dielectric 52. Furthermore, conductive films 58*a*-58*e* are arranged on a lower surface of dielectric film 62 (i.e., a major surface thereof facing the negative side in the direction along the z axis) in this order toward the negative side in the direction along the y axis in alignment without contacting each other.

Conductive films 60 each preferably include a major surface in the form of a rectangle. Note that the rectangle has a length slightly larger than the perimeter of dielectric 52 and also slightly smaller than the width of dielectric film 62. Furthermore, conductive films 60 are arranged on a lower surface of dielectric film 62 (i.e., a major surface thereof facing the negative side in the direction along the z axis) to have their respective lengths extending along the y axis and be also aligned equidistantly or substantially equidistantly in the direction along the x axis. Conductive films 58*a*-58*e* are thus electrically coupled by conductive films 60.

Figure 11:
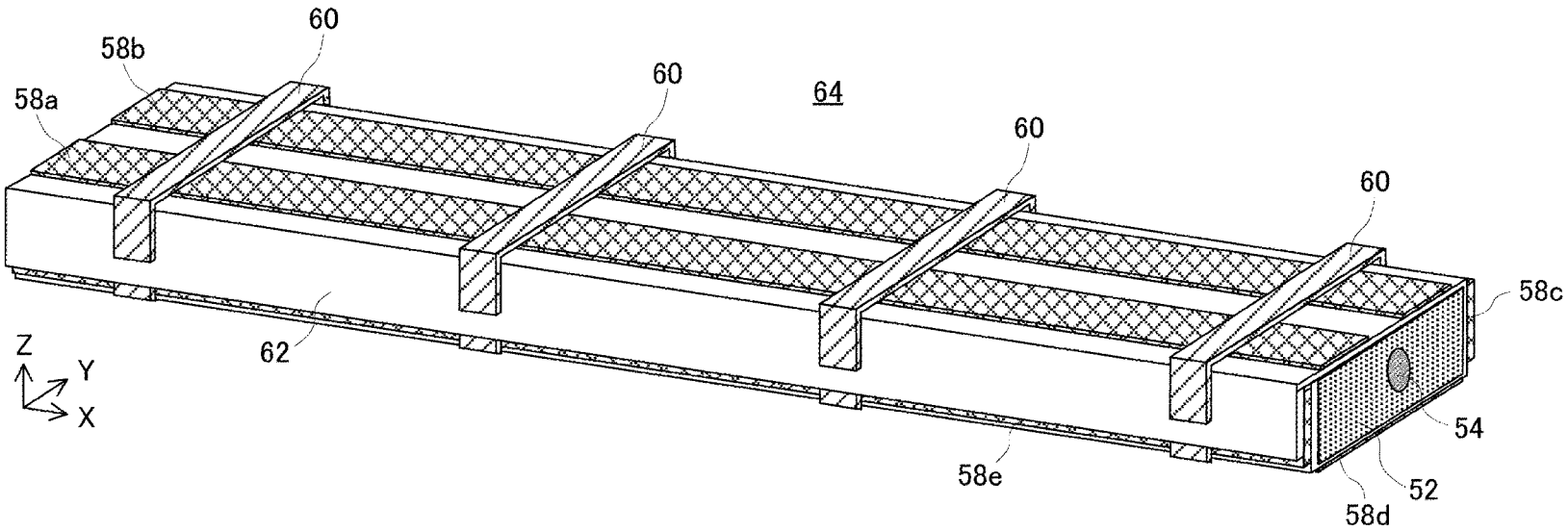
FIG. 11 is a perspective view of a high frequency transmission line that includes the FIG. 10 film member wound and is thus completed.
Figure 12:
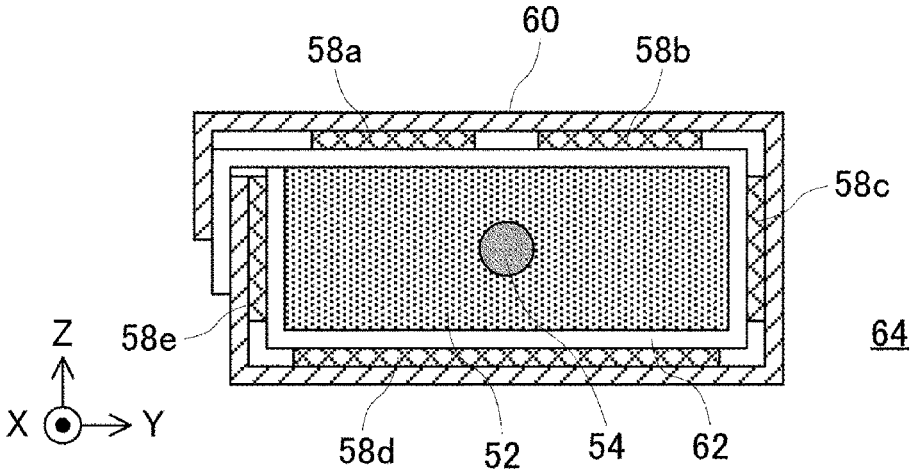
FIG. 12 is a diagram showing the FIG. 11 high frequency transmission line in a cross section perpendicular or substantially perpendicular to the x axis.

Film member 56 is wound on transmission member 50 in a manner as shown in FIGS. 11 and 12. More specifically, film member 56 is wound on transmission member 50 about the x axis with dielectric film 62 having the lower surface facing a major or side surface of transmission member 50. In the wounded condition, conductive films 58*a*-58*e* extend in a direction in which a signal propagates, and conductive films 60 extend in a direction across the direction in which the signal propagates.

Furthermore, conductive films 58*a* and 58*b* have major surfaces, respectively, exposed to the positive side in the direction along the z axis, conductive film 58*c* has a major surface exposed to the positive side in the direction along the y axis, and conductive film 58*d* has a major surface exposed to the negative side in the direction along the z axis. Note, however, that conductive film 58*e* has a major surface substantially covered with film member 56. Conductive films 60 have major surfaces substantially, externally exposed. Conductive films 60 each have opposite ends partially overlapping about the x axis and thus capacitively coupled. Thus, for a high frequency signal, conductive film 60 is regarded as having the opposite ends connected to each other.

Conductive films 58*a*-58*e* thus attached to transmission member 50 define and function as a ground conductor. Furthermore, conductive films 58*a*-58*e* cooperate with signal line conductor 54 to define a triplate structure, and between conductive films 58*a* and 58*b* a slit is arranged to extend along the x axis. Providing the slit between conductive films 58*a* and 58*b* allows signal line conductor 54 and the ground conductor to have a reduced distance therebetween while maintaining the transmission line's characteristic impedance. In other words, the transmission line is significantly reduced in thickness.

Furthermore, conductive films 60 define and function as a bridge conductor. This allows conductive films 58*a*-58*e* to be electrically connected in the direction along the x axis equidistantly or substantially equidistantly to stabilize ground potential. In other words, this prevents a large standing wave from arising between the slit's opposite ends as seen in the direction along the x axis, and in turn causing external extraneous emission. Furthermore, the present preferred embodiment only requires a single film member, and thus allows high frequency transmission line 64 to be fabricated more conveniently and also smaller in thickness than the above described preferred embodiment.

Figure 13:
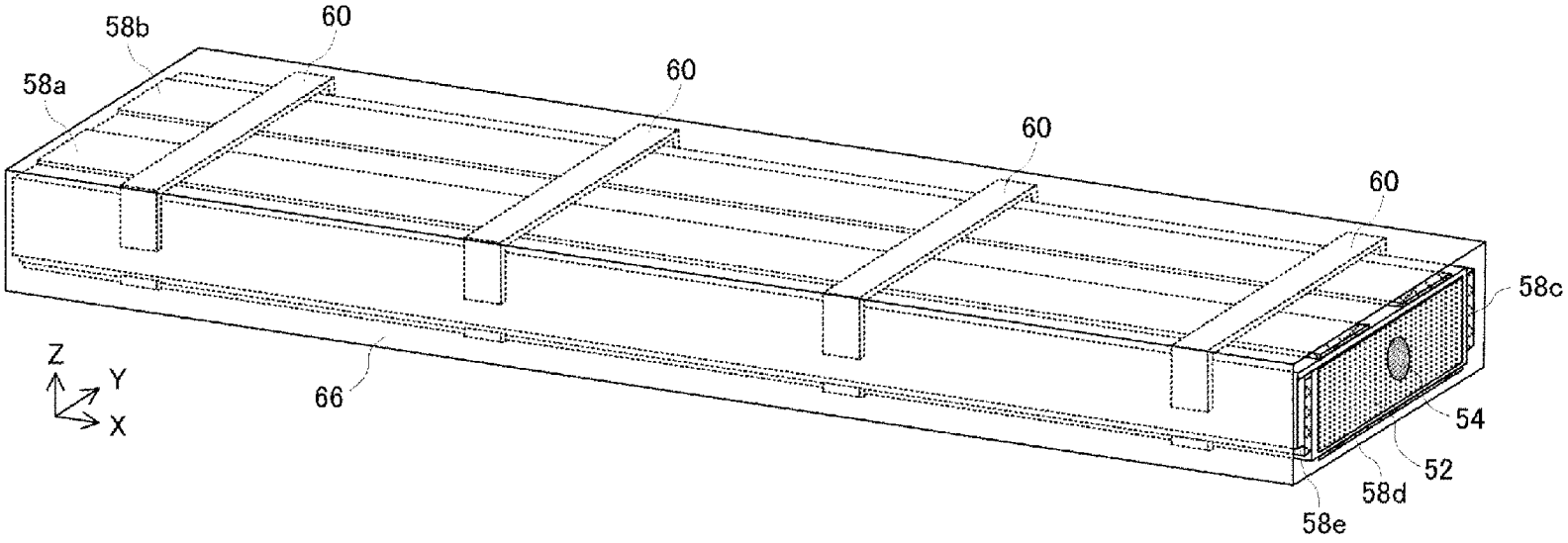
FIG. 13 is a perspective view of the FIG. 11 high frequency transmission line with an insulating protective layer wound thereon.

High frequency transmission line 64 thus fabricated is also preferably applied to a mobile communications terminal or similar high frequency equipment to connect between an antenna element or a similar high frequency element and an RF circuit or a similar high frequency device. Similarly as has been set forth above, high frequency transmission line 64 is connected to the high frequency device via coaxial connector 32. Note that conductive film 60 may have the opposite ends overlapping on an upper or lower surface of high frequency transmission line 64. Preferably, however, conductive film 60 have the opposite ends overlapping on a side surface of high frequency transmission line 64 in view of reducing high frequency transmission line 64 in thickness. Furthermore, as shown in FIG. 13, an insulating protective layer 66 may be provided to surround high frequency transmission line 64.

Figure 14:
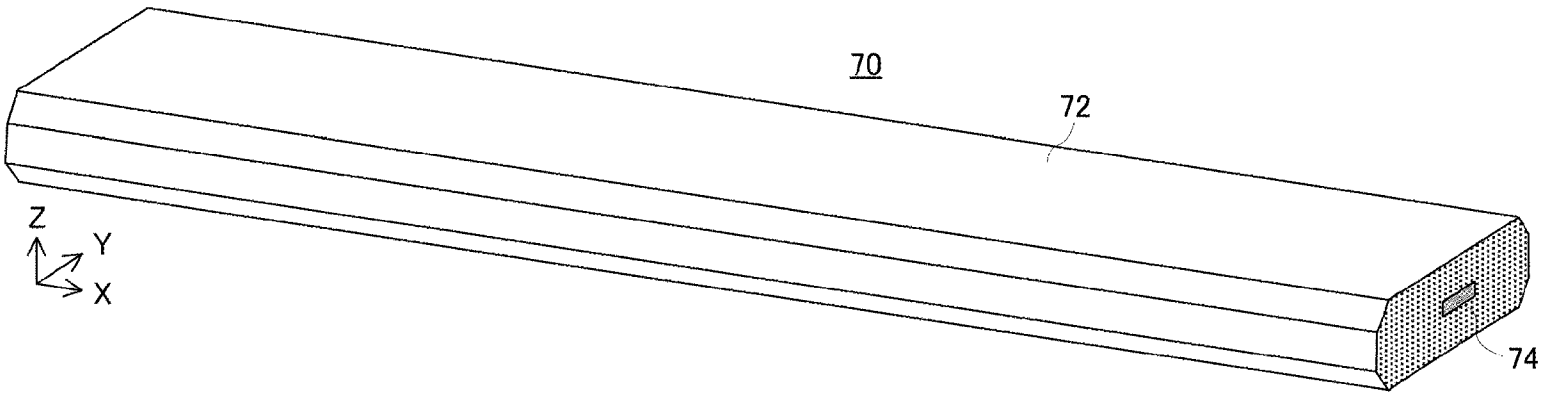
FIG. 14 is a perspective view of a transmission member according to another preferred embodiment of the present invention.

With reference to FIG. 14, another preferred embodiment provides a transmission member 70 including an elongated dielectric 72 made of Teflon®, PET, polyimide, or a similar dielectric material defining and serving as a source material. Dielectric 72 is preferably made of a single material extrusion-molded in one piece. Furthermore, dielectric 72 has a length along the x axis, a width along the y axis, and a thickness along the z axis. The length is adjusted as desired, and the width and the thickness are each adjusted to be uniform or substantially uniform along the entire length.

Furthermore, dielectric 72 preferably as an octagonal cross section perpendicular or substantially perpendicular to the x axis. More specifically, dielectric 72 includes two surfaces across the z axis to define and serve as major surfaces, and two surfaces across the y axis to define and serve as side surfaces. In addition, dielectric 72 includes four corners that are defined by mutually adjacent major and side surfaces chamfered to include four oblique surfaces.

Dielectric 72 has buried therein a signal line conductor 74 in the form of a plate extending along the x axis. Signal line conductor 74 is preferably made of a metallic material that contains silver, copper and/or the like as a major component and has a small resistivity defining and serving as a source material, and signal line conductor 74 is buried in dielectric 72 at a center as seen in a cross section thereof perpendicular or substantially perpendicular to the x axis. A high frequency signal propagates through signal line conductor 74 in the direction along the x axis.

Figure 15:
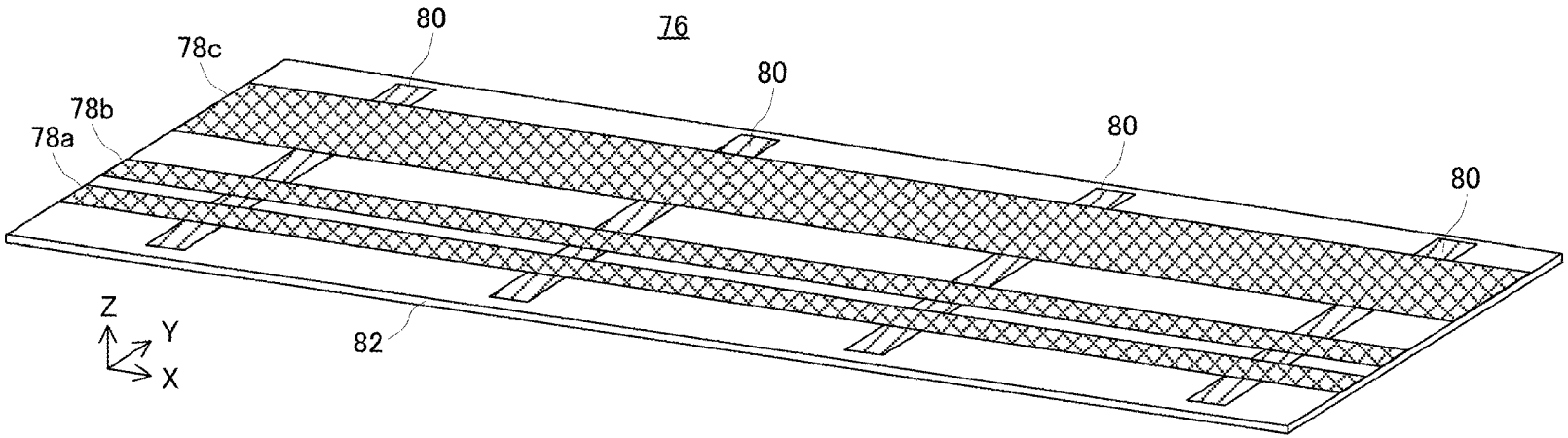
FIG. 15 is a perspective view of one example of a film member provided on the transmission member shown in FIG. 14.

With reference to FIG. 15, a film member 76 is preferably a dielectric film 82 made of Teflon®, PET, polyimide or a similar, dielectric and heat-shrinkable material defining and serving as a source material; and conductive films 78*a*-78*c*, 80 made of aluminum foil defining and serving as a source material, and printed on a major surface of dielectric film 82. Dielectric film 82 has the major surface preferably in the form of a rectangle having a length, a width, and a thickness along the x, y and z axes, respectively. Furthermore, the length of dielectric film 82 matches or substantially matches that of dielectric 72, and the width of dielectric film 82 is slightly larger than a perimeter of dielectric 72 about the x axis.

Conductive films 80 each preferably include a major surface in the form of a rectangle. Note that the rectangle has a length slightly larger than the perimeter of dielectric 82 and also slightly smaller than the width of dielectric film 82. Furthermore, conductive films 80 are arranged on an upper surface of dielectric film 82 (i.e., an upper surface thereof facing the negative side in the direction along the z axis) to have their respective lengths extending along the y axis and be also aligned equidistantly or substantially equidistantly in the direction along the x axis.

Conductive films 78*a*-78*c* all match or substantially match dielectric film 82 in length. Note, however, that conductive films 78*a* and 78*b* each have a width slightly smaller than about ½ of that of the major surface of dielectric 72, and conductive film 78*c* has a width slightly smaller than that of the major surface of dielectric 72. Furthermore, conductive films 78*a*-78*c* are printed on an upper surface of dielectric film 82 (i.e., a major surface thereof facing the positive side in the direction along the z axis) in this order toward the negative side in the direction along the y axis in alignment without contacting each other. Conductive films 78*a*-78*c* are electrically coupled by conductive films 80.

Figure 16:
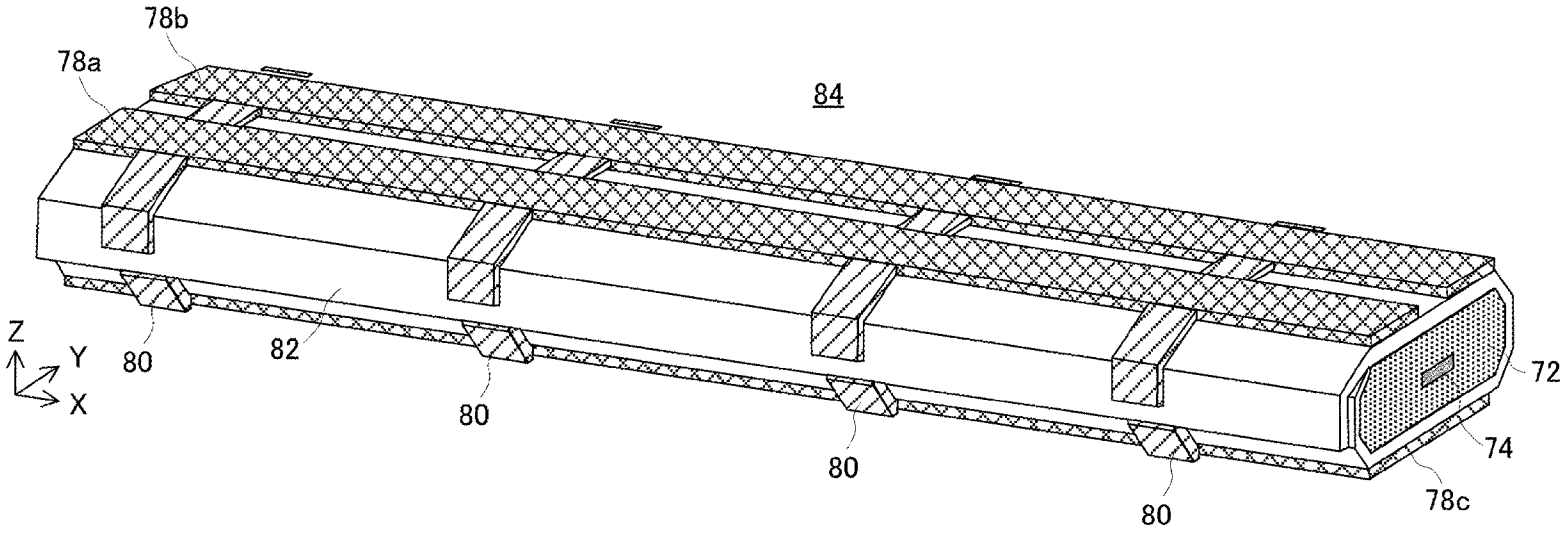
FIG. 16 is a perspective view of a high frequency transmission line that includes the FIG. 15 film member wound and is thus completed.

Film member 76 is wound on transmission member 70 in a manner as shown in FIG. 16. More specifically, film member 76 is wound on transmission member 70 about the x axis with dielectric film 82 having the lower surface facing a major, side or oblique surface of transmission member 70. In this wound configuration, conductive films 78*a*-78*c* extend in a direction in which a signal propagates, and conductive films 80 extend in a direction across the direction in which the signal propagates.

Furthermore, conductive films 78*a* and 78*b* have major surfaces, respectively, exposed to the positive side in the direction along the z axis, and conductive film 78*c* has a major surface exposed to the negative side in the direction along the z axis. Conductive films 80 have major surfaces substantially, externally exposed. Conductive films 80 each have opposite ends partially overlapping about the x axis. Thus, for a high frequency signal, conductive film 80 is regarded as having the opposite ends connected to each other.

Conductive films 78*a*-78*c* thus attached to transmission member 70 define and function as a ground conductor. Furthermore, conductive films 78*a*-78*c* cooperate with signal line conductor 74 to form a triplate structure, and between conductive films 78*a* and 78*b* a slit is arranged to extend along the x axis. Providing the slit between conductive films 78*a* and 78*b* allows signal line conductor 74 and the ground conductor to have a reduced distance therebetween while maintaining the transmission line's characteristic impedance. In other words, the transmission line is significantly reduced in thickness.

Furthermore, conductive films 80 define and function as a bridge conductor. This allows conductive films 78*a*-78*c* to be electrically connected in the direction along the x axis equidistantly or substantially equidistantly to stabilize ground potential. In other words, this prevents a large standing wave from arising at an end of the slit as seen in the direction along the x axis, and in turn causing external extraneous emission. Furthermore, the present preferred embodiment only requires a single film member, and thus allows high frequency transmission line 84 to be fabricated more conveniently and also smaller in thickness than the above described preferred embodiment.

Furthermore, the present preferred embodiment provides dielectric 72 preferably with a polygonal cross section and thus allows high frequency transmission line 84 to be bent with conductive film 80 including a corner experiencing a further smaller stress than the above described preferred embodiment does. That is, high frequency transmission line 84 is further be enhanced in flexibility.

High frequency transmission line 84 thus fabricated is also applied to a mobile communications terminal or similar high frequency equipment to connect between an antenna element or a similar high frequency element and an RF circuit or a similar high frequency device. Similarly as has been set forth above, high frequency transmission line 84 is connected to the high frequency device via coaxial connector 32. Note that conductive film 80 may have the opposite ends overlapping on an upper or lower surface of high frequency transmission line 84. Preferably, however, conductive film 80 preferably has its opposite ends overlapping on a side surface of high frequency transmission line 84 in view of reducing high frequency transmission line 84 in thickness.

Figure 17:
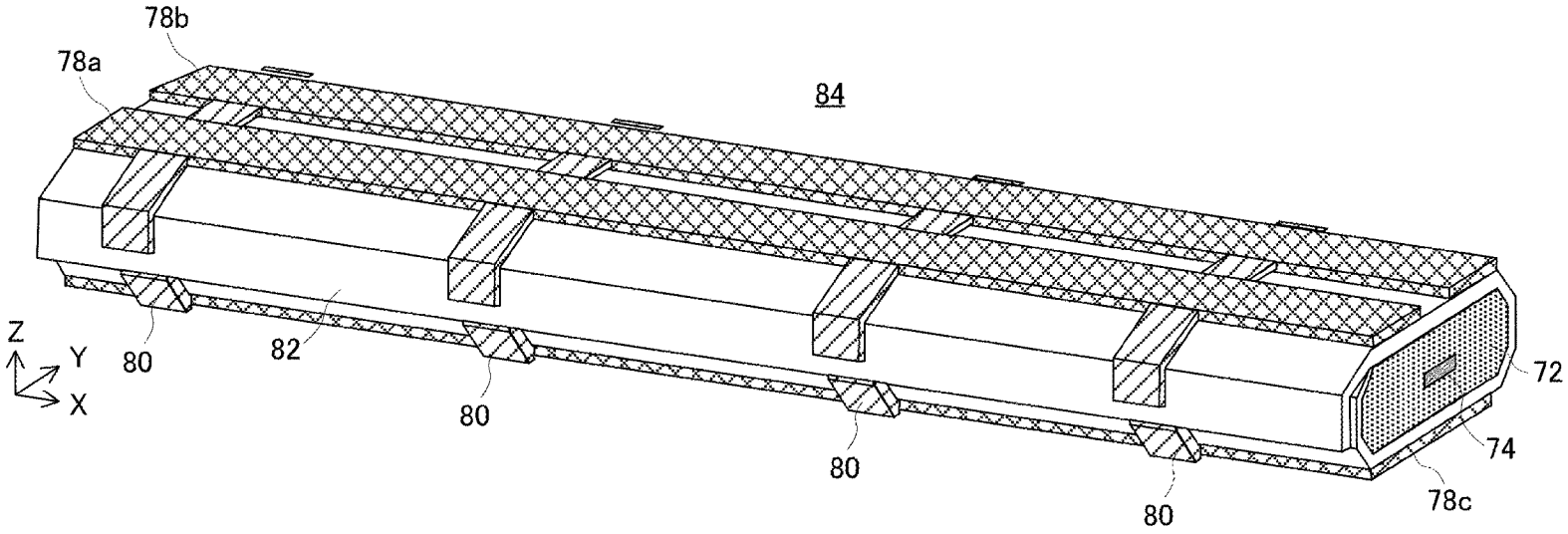
FIG. 17 is a perspective view of the FIG. 16 high frequency transmission line with an insulating protective layer wound thereon.

Furthermore, as shown in FIG. 17, an insulating protective layer 86 may be provided to surround high frequency transmission line 84. Furthermore, while the present preferred embodiment provides dielectric 72 with a polygonal cross section, it may have a round cross section including an elliptical cross section, for example.

Figure 18:
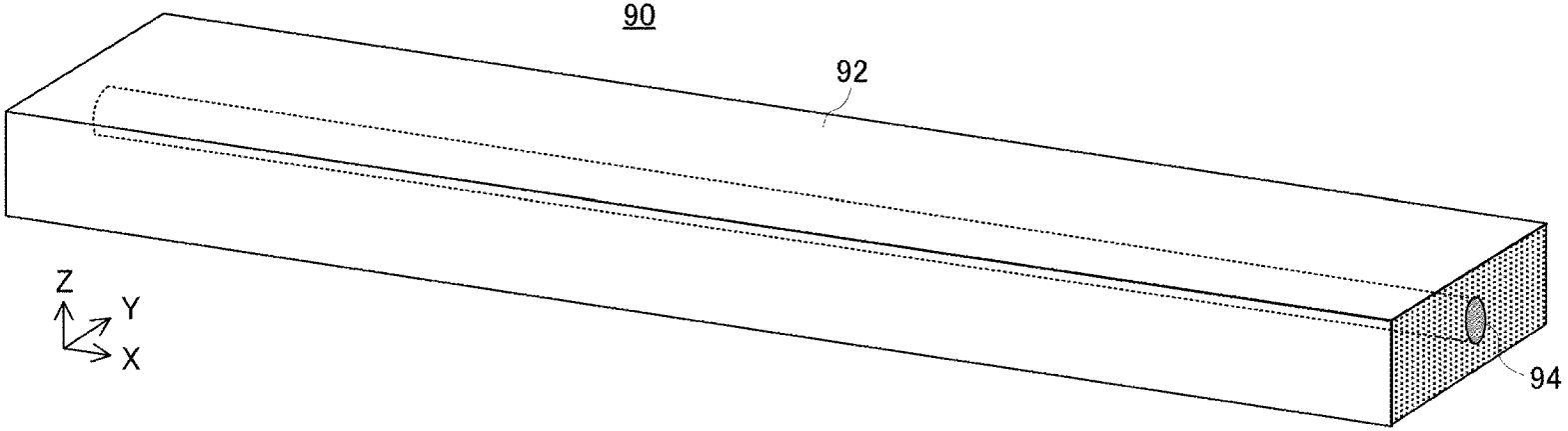
FIG. 18 is a perspective view of a transmission member according to still another preferred embodiment of the present invention.
Figure 19:
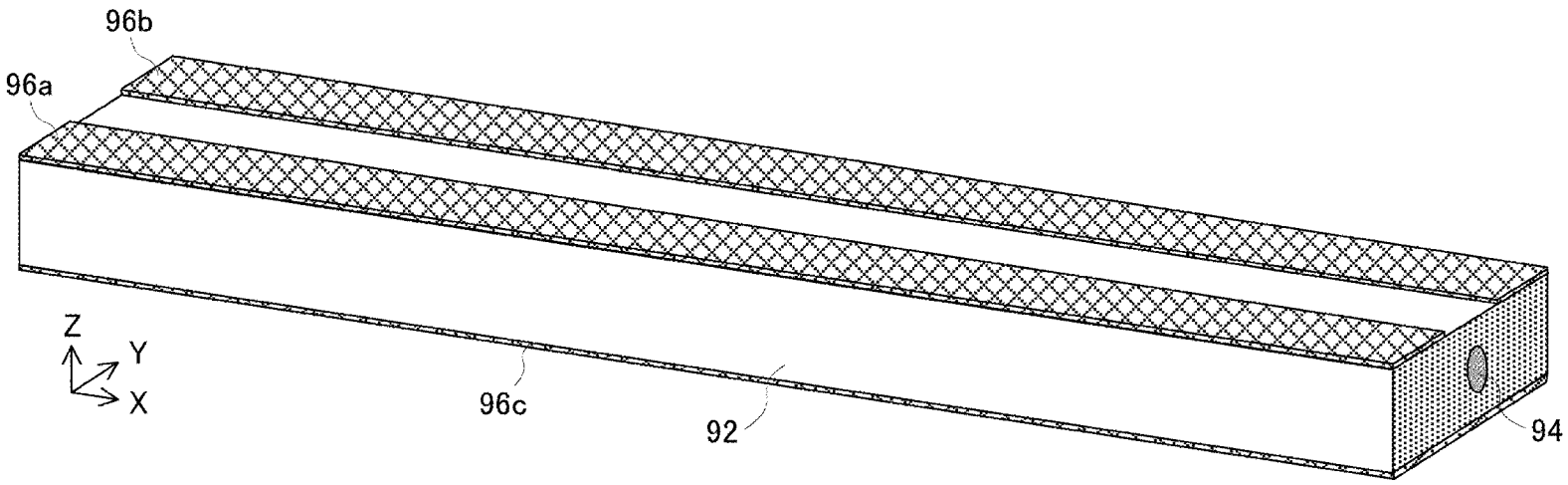
FIG. 19 is a perspective view of the FIG. 18 transmission member with a ground layer provided thereto.

With reference to FIG. 18, the present preferred embodiment provides a transmission member 90 including a dielectric 92 preferably with a square pillar configuration and made of Teflon®, PET, polyimide, or a similar dielectric material serving as a source material. Dielectric 92 is preferably configured by a single material extrusion-molded in one piece. Furthermore, dielectric 92 has a length along the x axis, a width along the y axis, and a thickness along the z axis. The length is adjusted as desired, and the width and the thickness are each adjusted to be uniform along the entire length.

Dielectric 92 has buried therein a signal line conductor 94 extending along the x axis. Signal line conductor 94 is preferably made of a metallic material that contains silver, copper and/or the like as a major component and has a small resistivity defining and serving as a source material, and signal line conductor 94 is buried in dielectric 92 at a center as seen in a cross section thereof perpendicular or substantially perpendicular to the x axis. A high frequency signal propagates through signal line conductor 94 in the direction along the x axis.

Dielectric 92 includes one major surface (a major surface facing the positive side in the direction along the z axis) with conductive films 96*a* and 96*b* that are made of copper foil defining and serving as a source material bonded thereto through thermocompression or the like. Dielectric 92 also includes the other major surface (a major surface facing the negative side in the direction along the z axis) with a conductive film 96*c* that is formed with copper foil defining and serving as a source material bonded thereto through thermocompression or the like. More specifically, conductive films 96*a*-96*c* are all provided as follows: after dielectric 92 is extrusion-molded, a rolled copper foil is compression-bonded thereto.

Conductive films 96*a*-96*c* all match or substantially match dielectric 92 in length. Conductive film 96*c* matches or substantially matches dielectric 92 in width. Note, however, that conductive films 96*a* and 96*b* each have a width slightly smaller than about ½ of that of dielectric 92. Furthermore, conductive film 96*a* and one major surface of dielectric 92 have ends, respectively, on the negative side in the direction along the y axis in contact with each other, and conductive film 96*b* and one major surface of dielectric 92 have ends, respectively, on the positive side in the direction along the y axis in contact with each other.

Figure 20:
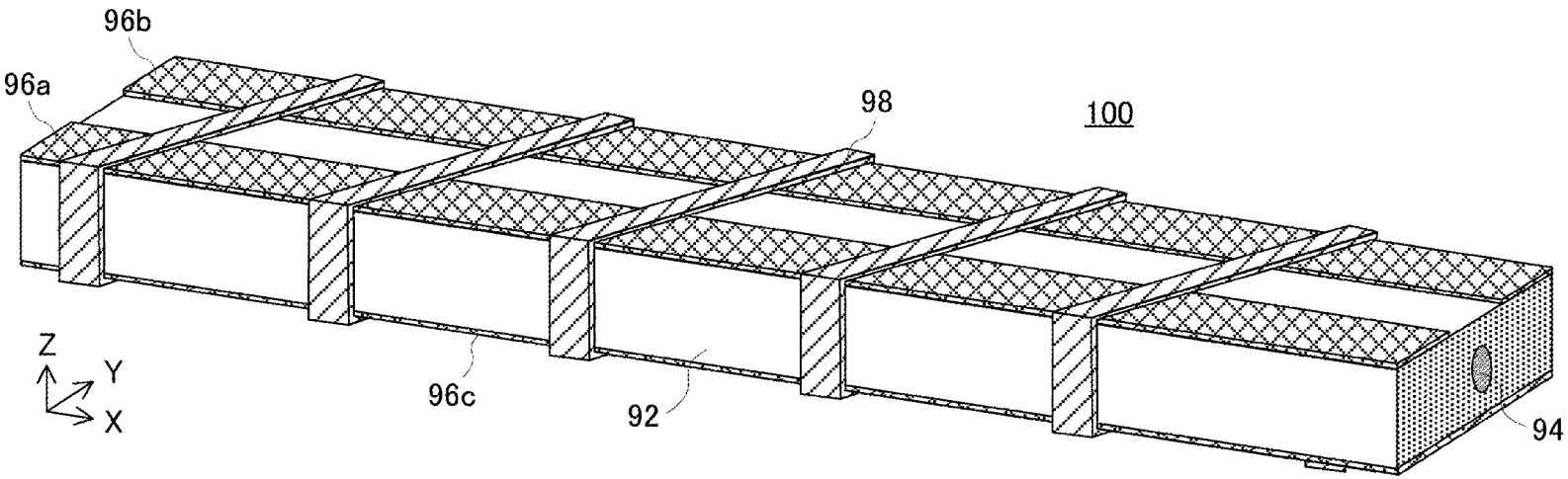
FIG. 20 is a perspective view of a high frequency transmission line that includes a bridge conductor in the form of a strip helically wound and is thus completed.
Figure 21:
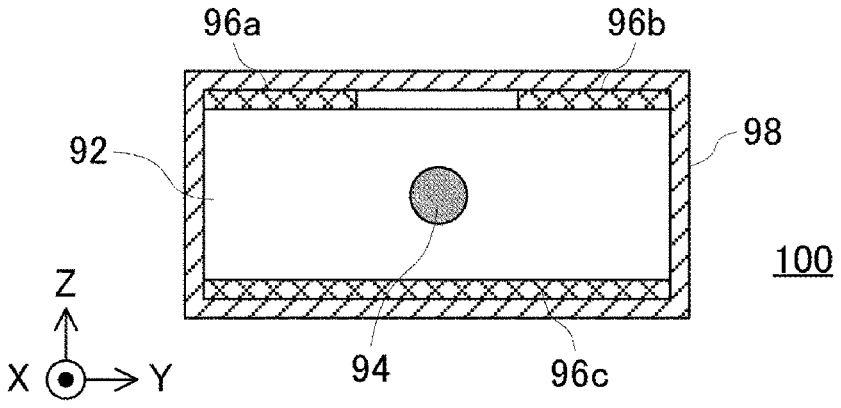
FIG. 21 is a diagram showing the FIG. 20 high frequency transmission line in a cross section perpendicular or substantially perpendicular to the x axis.

Once conductive films 96*a*-96*c* have completely been provided, then, as shown in FIG. 20 and FIG. 21, a conductor 98 in the form of a ribbon is helically wound on transmission member 90. Conductor 98 thus has a major surface in contact with that of conductive films 96*a*-96*c*, and conductive films 96*a*-96*c* are thus electrically connected via conductor 98. Note that, preferably, adjacent helices are spaced by a distance equal to or smaller than about ½ of a wavelength corresponding to a maximum frequency of a high frequency signal to be transmitted. This significantly reduces or prevents extraneous emission provided from a slit formed between conductors 96*a* and 96*b*, a side surface of dielectric 92, and/or the like.

Figure 22:
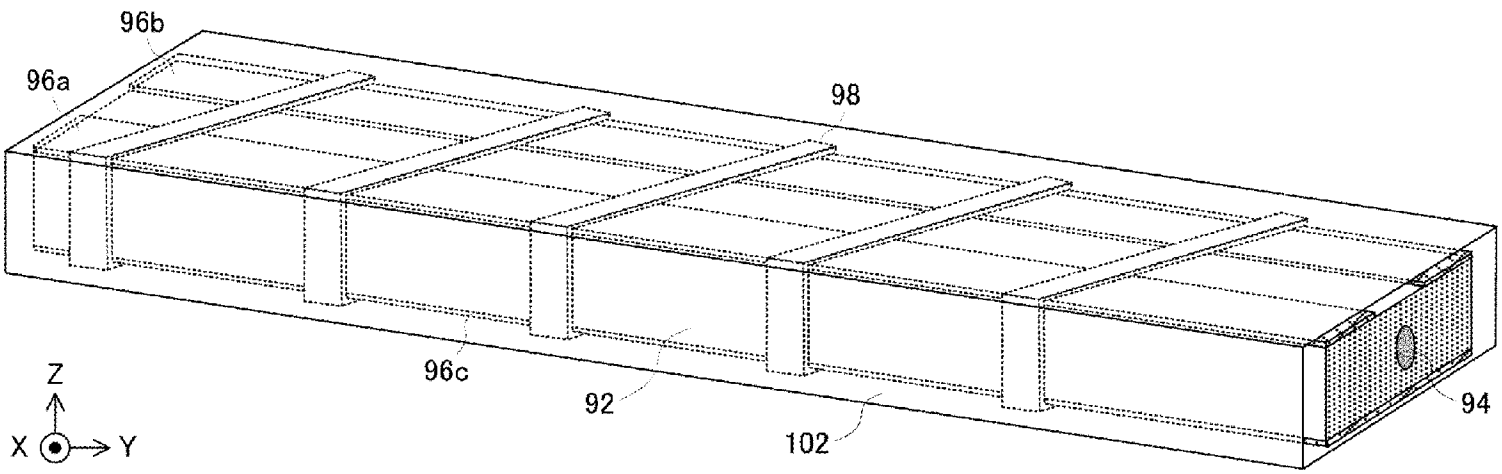
FIG. 22 is a perspective view of the FIG. 21 high frequency transmission line with an insulating protective layer wound thereon.

A high frequency transmission line 100 thus fabricated is also preferably applied to a mobile communications terminal or similar high frequency equipment to connect between an antenna element or a similar high frequency element and an RF circuit or a similar high frequency device. Similarly as has been set forth above, high frequency transmission line 100 is preferably connected to the high frequency device via coaxial connector 32. Note that, as shown in FIG. 22, an insulating protective layer 102 may be arranged to surround high frequency transmission line 100. Furthermore, in order to increase an anchor effect of conductive films 96*a*-96*c*, conductive films 96*a*-96*c* may include a back surface with a projection, or furthermore, may be provided with a small hole successively to allow dielectric 92 to enter the hole.

Furthermore, while the above preferred embodiments preferably use extrusion-molding to provide dielectric 12, 52, 72, or 92, for example, dielectric 12, 52, 72, or 92 may be formed of a plurality of dielectric substrates stacked in layers.

Furthermore, while the preferred embodiments of FIGS. 1-8 preferably provide film member 16 wound on transmission member 10, transmission member 10 may be introduced into a cylindrical film arranged in a pattern.

Figure 23A:
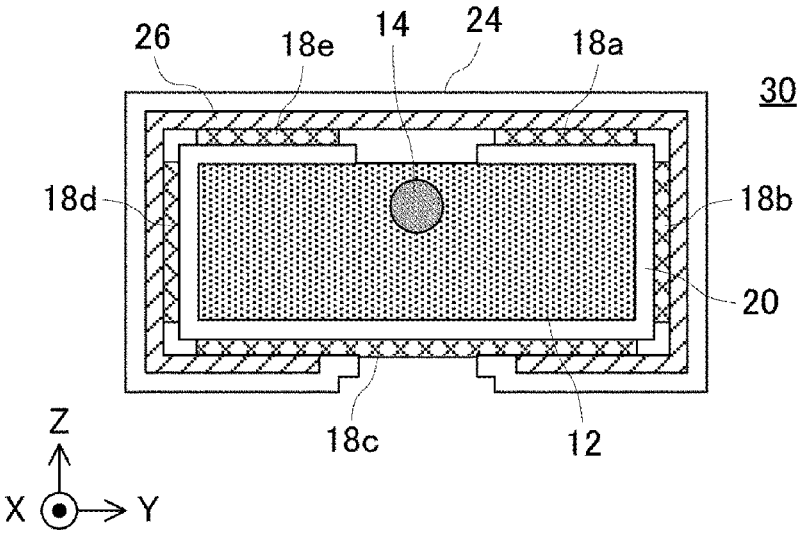
FIG. 23A corresponds to the FIG. 6 cross section with a signal line conductor positionally displaced in a direction along a z axis, and FIG. 23B corresponds to the FIG. 6 cross section with a transmission member having a corner with a conductor slit eliminated therefrom.

Furthermore, the preferred embodiments of FIGS. 1-8 provide signal line conductor 14 buried in dielectric 12 at a center as seen in a cross section thereof perpendicular or substantially perpendicular to the x axis. Alternatively, signal line conductor 14 may be buried in dielectric 12 at a position offset in the direction along the y axis and/or the direction along the z axis from the center as seen in the cross section thereof perpendicular or substantially perpendicular to the x axis, and furthermore, signal line conductor 14 may partially be exposed at a side surface of dielectric 12 along the x axis. Note that if signal line conductor 14 is buried at a position offset in the direction along the z axis, high frequency transmission line 30 is configured, as shown in FIG. 23A, in a cross section perpendicular or substantially perpendicular to the x axis.

Figure 23B:
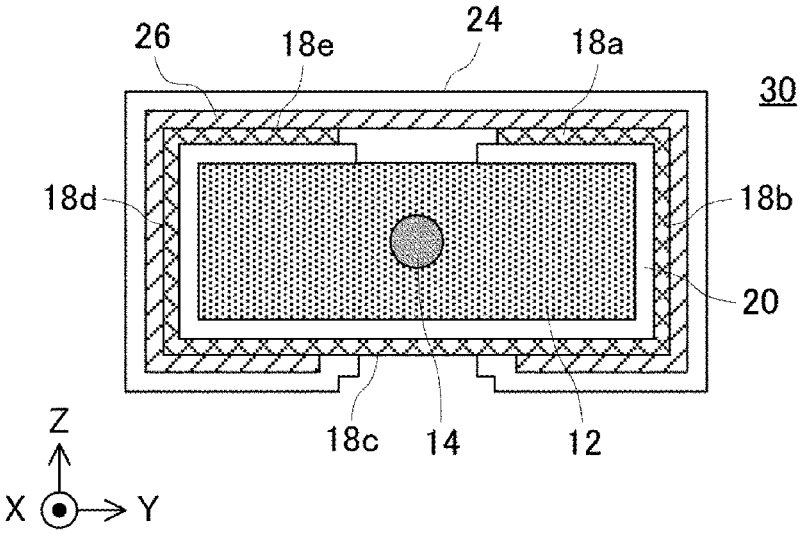

Furthermore, the preferred embodiments of FIGS. 1-8 preferably provide five conductive films 18*a*-18*e* printed on a major surface of dielectric film 20 such that when film member 16 is wound on transmission member 10, transmission member 10 has a corner with a conductor silt. However, if it is not necessary to provide the slit, a single conductive film equal or substantially equal in size to the major surface of dielectric film 20 may be provided on the major surface of dielectric film 20. In that case, high frequency transmission line 30 is configured, as shown in FIG. 23B, in a cross section perpendicular or substantially perpendicular to the x axis.

Furthermore, the preferred embodiments of FIGS. 9-13 preferably provide conductive films 60 to each partially overlap about the x axis to capacitively couple its opposite ends. Alternatively, each conductive film 60 may include such an overlapping portion with a through hole or via conductor that penetrates dielectric film 62 to allow each conductive film 60 to have opposite ends directly connected together.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A transmission line comprising:

a signal line conductor extending in a direction in which a signal propagates;

a dielectric body, extending in the direction in which the signal propagates, to bury the signal line conductor therein, and the dielectric body including a first major surface and a second major surface opposite to the first major surface, and a side surface contiguous to the first and second major surfaces;

a ground conductor disposed on the first major surface of the dielectric body such that, in a plan view, a conductor-free portion is provided along the signal line conductor to overlap the signal line conductor; and a bridge conductor disposed on the first major surface of the dielectric body to straddle the conductor-free portion and also electrically connect to the ground conductor; wherein the bridge conductor is provided on a first film which is wrapped around the dielectric body; and the ground conductor is provided on a second film which is wrapped around the dielectric body.

2. The transmission line according to claim 1, wherein the ground conductor includes conductive films arranged to define together with the signal line conductor a triplate structure.

3. A mobile communications terminal comprising:

an antenna element;

an RF circuit; and the transmission line according to claim 1 arranged to connect the antenna element and the RF circuit.

4. The transmission line according to claim 1, wherein the ground conductor is disposed on the side surface of the dielectric body in addition to being disposed on the first major surface of the dielectric body.

5. The transmission line according to claim 1, wherein the first film is wrapped around the second film.

6. The transmission line according to claim 1, wherein the bridge conductor has a length larger than a length of a perimeter of the dielectric body.

7. The transmission line according to claim 1, wherein at least one of the first and second films is heat-shrinkable.

8. The transmission line according to claim 1, wherein the ground conductor includes a plurality of first conductive films each with a width smaller than about ½ of that of the dielectric body, a plurality of second conductive films each with a width smaller than a thickness of the dielectric body, and a third conductive film with a width smaller than that of the dielectric body.

9. The transmission line according to claim 8, wherein a slit is provided between at least two of the plurality of first conductive films, the plurality of second conductor films, and the third conductor film of the ground conductor.

10. The transmission line according to claim 1, wherein the ground conductor includes conductive films arranged to define together with the signal line conductor a triplate structure.

11. A transmission line comprising:

a signal line conductor extending in a direction in which a signal propagates;

a dielectric body, extending in the direction in which the signal propagates, to bury the signal line conductor therein, and the dielectric body including a first major surface and a second major surface opposite to the first major surface, and a side surface contiguous to the first and second major surfaces;

a ground conductor disposed on the first major surface of the dielectric body such that, in a plan view, a conductor-free portion is provided along the signal line conductor to overlap the signal line conductor; and a bridge conductor disposed on the first major surface of the dielectric body to straddle the conductor-free portion and also electrically connect to the ground conductor; wherein the bridge conductor is a linear conductor which is wrapped around the dielectric body; and the ground conductor is provided on a film on the dielectric body.

12. The transmission line according to claim 11, wherein the film is heat-shrinkable.

13. The transmission line according to claim 11, wherein the ground conductor includes a plurality of first conductive films each with a width smaller than about ½ of that of the dielectric body, a plurality of second conductive films each with a width smaller than a thickness of the dielectric body, and a third conductive film with a width smaller than that of the dielectric body.

14. The transmission line according to claim 11, wherein the bridge conductor is wrapped around the dielectric body about an axis extending along the direction in which the signal propagates.

15. A mobile communications terminal comprising:

an antenna element;

an RF circuit; and the transmission line according to claim 11 arranged to connect the antenna element and the RF circuit.

16. The transmission line according to claim 11, wherein the bridge conductor and the ground conductor are provided on the film.

17. The transmission line according to claim 11, wherein the film includes a first film and a second film provided on the first film, the ground conductor is provided on the first film on the dielectric body, and the bridge conductor is provided on the second film.

18. The transmission line according to claim 11, wherein the bridge conductor has a length larger than a length of a perimeter of the dielectric body.

* * * * *